US005309127A

United States Patent [19]

Mariani

[11] Patent Number: 5,309,127

[45] Date of Patent: May 3, 1994

[54] PLANAR TUNABLE YIG FILTER

[75] Inventor: Elio A. Mariani, Hamilton Square, N.J.

[73] Assignee: The United States of America as represented by the Secretary of the Army, Washington, D.C.

[21] Appl. No.: 991,558

[22] Filed: Dec. 11, 1992

[51] Int. Cl.[5] ..... H01P 1/218

[52] U.S. Cl. ..... 333/202; 333/205; 333/219.2

[58] Field of Search ..... 333/202, 204, 205, 219, 333/219.2, 148, 235, 201, 246; 331/107 DP, 107 SL, 96

[56] References Cited

U.S. PATENT DOCUMENTS 4,197,517 4/1980 Vittoria ..... 333/205
4,983,936 1/1991 Murakami et al. ..... 333/219.2 X

FOREIGN PATENT DOCUMENTS 2-15203 8/1990 Japan ..... 333/201
0105401 4/1992 Japan ..... 333/201
1693659 11/1991 U.S.S.R. ..... 333/201

OTHER PUBLICATIONS

Thiess, George H., "Theory and Design of Tunable YIG Letters", *Microwaves*, Sep., 1964, pp. 14-24.

*Primary Examiner*—Seungsook Ham
*Attorney, Agent, or Firm*—Michael Zelenka; William H. Anderson

[57] ABSTRACT

A planar tunable YIG filter assembly comprising a first substrate having on one side thereof spaced ridges, a first conductor spaced from and between the ridges, a dielectric spacer and YIG disk is mounted on said spacer whereby, a bandpass filter is established between said first conductor and a second conductor that is orthogonal with said first conductor and on a second substrate that is in contact with the ridges when means are provided for producing a magnetic field that is perpendicular to the substrate in the area of intersection of the first and second conductors.

5 Claims, 2 Drawing Sheets

PLANAR TUNABLE YIG FILTER

GOVERNMENT INTEREST

The invention described herein may be manufactured, used, and licensed by or for the Government of the United States of America for governmental purposes without the payment to us of any royalty thereon.

FIELD OF THE INVENTION

This invention is in the field of electrical (RF/microwave) filters.

BACKGROUND OF THE INVENTION

1. Description of the Prior Art

What is called a YIG (yttrium, iron, garnet) bandpass filter has been used in microwave circuits. It may be comprised of input and output conductors (i.e. transmission lines) in different parallel planes that intersect at 90° when viewed in a direction perpendicular to the planes. A sphere or disc of YIG material is located between the conductors at the point where they intersect. Ordinarily, there would be no coupling between the orthogonal conductors, but the presence of an applied DC magnetic field passing through the YIG sphere or disc in a direction perpendicular to the planes permits coupling to occur in a band of frequencies determined by the strength of the applied magnetic field.

At present, such filters are constructed as discrete units that are normally expensive and rather bulky. When they are used with microwave integrated circuits (MIC's) that are formed on a substrate such as GaAs or Si,, they must be mounted on the substrate and electrically connected to the circuits therein. Thus, they are not integral and are basically incompatible with the MIC.

BRIEF SUMMARY OF THE INVENTION

In accordance with this invention, a thin, planar assembly is provided that can be placed over a conductor of a planar microwave integrated circuit, MIC, so as to couple over a desired band of microwave frequencies to that conductor. The assembly includes a planar substrate having conductive material on one side to form a ground plane and a conductor (i.e. transmission line) on the second side. A dielectric spacer is adhered to the conductor, and a YIG disc is adhered to the spacer. Additional dielectric spacers are located on the second side of the substrate on either side of the conductor. In addition, means for providing magnetic flux that passes perpendicularly through the substrate may, if desired, be adhered to its first side.

In use, the planar assembly just described is mounted on a MIC with an orientation such that its conductor is at 90° with the conductor in the MIC to which coupling is to be attained. The thickness of the additional spacers on either side of the conductor of the assembly is greater than the combined thickness of the YIG disc and its spacer so that there is an appropriate space between the YIG disc and the conductor on the MIC. The band of frequencies over which the filter assembly will operate is determined by the strength of the DC magnetic field where the frequency may be varied by changing the exact strength of the applied magnetic field.

When the filter assembly is mounted on the MIC, it is an integral part thereof, and no special means (i.e. cable and connectors) are required for incorporating it into the MIC except for allowing an appropriate area for its mounting. Furthermore, the expected cost of the filter assembly would be much less than that of current YIG filters.

BRIEF DESCRIPTION OF THE DRAWINGS

Various embodiments of the present invention are described below with reference to the drawings, in which like items are identified by the same reference designation, and in which.

DETAILED DESCRIPTION OF THE DRAWINGS

Figure 1:
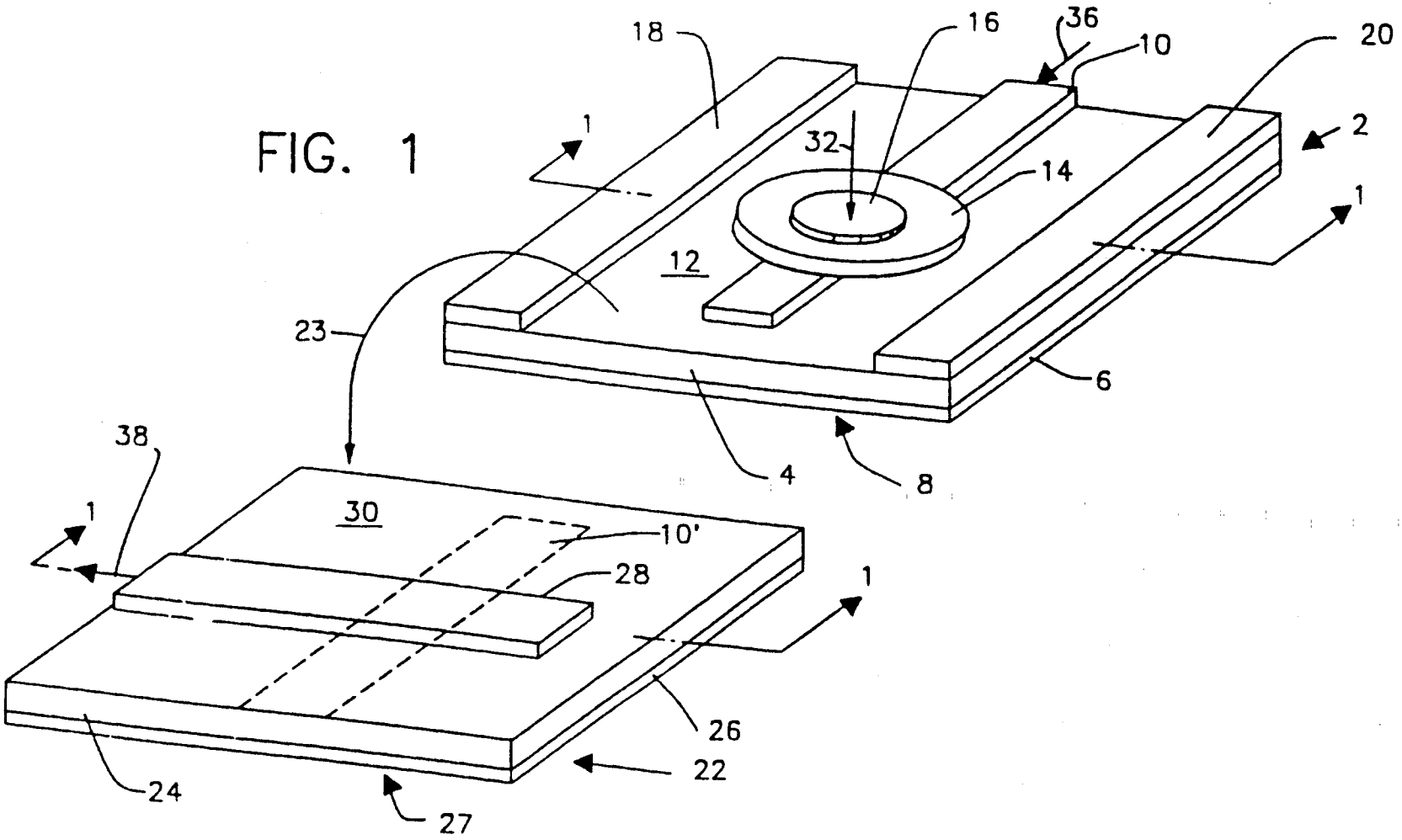
FIG. 1 is an oblique view of a filter assembly of this invention.

A filter assembly 2 of this invention that is shown in FIG. 1 includes a planar substrate 4 that is preferably made of dielectric material such as an $Al_2O_3$ ceramic. Conductive material6 covers a first side 8 thereof, and a strip conductor 10 is adhered to a second side 12. A spacer disc 14 of dielectric material is adhered to the strip 10 and the side 12, and a disc 16 of YIG material is adhered to the disc 14. Additional spacers, herein shown by way of example as being strips of dielectric material 18 and 20, are adhered to the second side 12 of the substrate 4 on opposite sides of the conductor 10.

FIG. 1 also shows a section of a MIC 22 on which the filter assembly 2 is to be mounted. The MIC is comprised of a substrate 24 that is usually made of material such as GaAs or Si. Conductive material 26 covers a first side 27 of the substrate 24, and a strip conductor (i.e. transmission line) 28 is adhered to a second side 30. When the filter assembly 2 of FIG. 1 is rotated as indicated by the arrow 23 onto the top of the MIC section 22, it is seen that the conductors 10 and 28 will lie on separated planes and that they are at right angles with respect to each other when viewed in a direction perpendicular to the substrates 4 and 24.

The position of the conductor 10, when the filter assembly 2 is mounted as just described, is indicated by dashed lines 10'. In order to obtain maximum coupling, each of the conductors 10 and 28 extends past their center of intersection (indicated by line 32) by one-quarter of a wavelength at the center frequency of the band being coupled. In this particular example, rf signals entering the conductor 10 of FIG. 1, as indicated by an arrow 36, would flow from the conductor 28 as indicated by an arrow 38.

Figure 2:
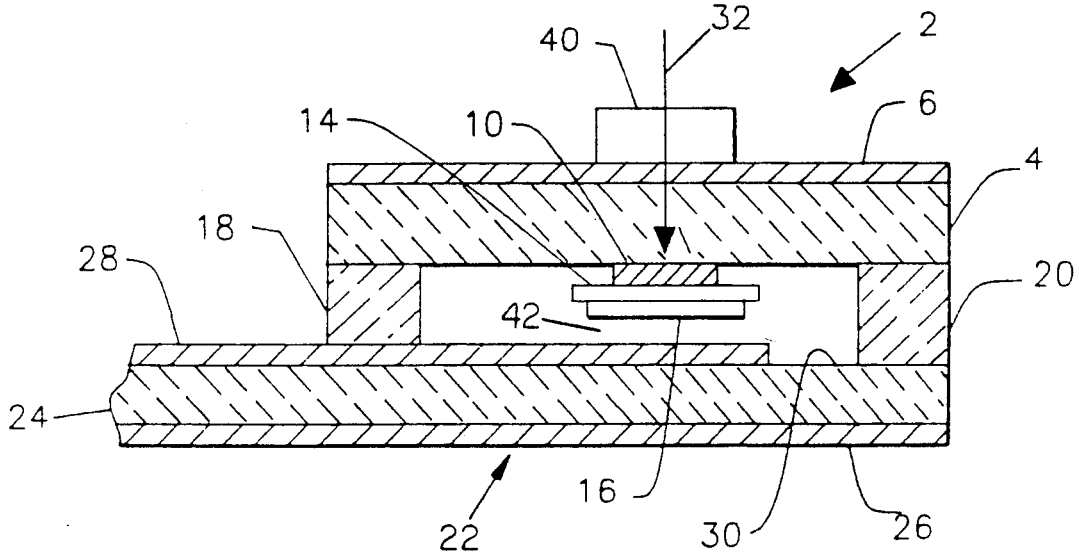
FIG. 2 is a cross section of a filter assembly of this invention and a MIC on which it is mounted, taken along a line A—A that is perpendicular to the conductor of the assembly as indicated in FIG. 1.

FIG. 2 is a cross section at AA of the filter assembly 2 and the MIC 22 of the structure formed when the filter assembly 2 is mounted onto the MIC 22 as indicated by the arrow 23. In the interest of clarity, the dimensions are greatly exaggerated. In this view, a means 40 is shown on top of the metal covering 6 for producing a magnetic biasing field in the direction of the arrow 32. As preferred, the thickness of the spacers 18 and 20 is greater than the combined thickness of the conductor 10, the spacer 14 and the YIG disc 16 by an amount such that the space 42 between the YIG disc 16 and the conductor 28 is approximately the same as the thickness of the spacer 14, taking into account the asymmetry of the structure near the YIG disc.

That a filter of this invention would have reasonable dimensions can be seen from the following calculations. From the paper referred to, the formula for the external Q, Qe of a YIG disc is:

$$Q_e = \frac{3340wh}{4\pi M_s r^2 t} \quad (1)$$

where w = width of stripline center conductor r = radius of disc resonator h = ground plane spacing $4\pi M_s$ = saturation megnetization, which is 1750 gauss for a YIG at 20° C.

It is known that:

$$Q_L = \frac{Q_e Q_u}{Q_e + Q_u} \quad (2)$$

where $Q_L$ is the loaded Q and $Q_u$ is the unloaded Q. Thus, if $Q_u$ for a YIG disc at 20 GHz is 25,000 then:

$$Q_L = \frac{Q_e \cdot 25{,}000}{Q_e + 25{,}000} \quad (3)$$

so that $Q_e \cong Q_L$. If the disc is operating at 20 GHz and the tuning range is 100 MHz, then:

$$Q_L = \frac{f_o}{\Delta f_1} = \frac{20\text{ GHz}}{0.1\text{ GHz}} = 200 \quad (4)$$

Since $Qe = Q_L$, $Q_e = 200$. Substituting this in equation (1) shows that:

$$\frac{wh}{r^2 t} = 104 \quad (5)$$

It is known that a YIG disc resonator with a diameter of 0.150" and a thickness of 0.005" operated at 2.0 GHz. Therefore, for 20 GHz let h=0.10" and assume that w/h=1.0 so that w=0.10". Substitution in equation (5) yields:

$$104 = \frac{(0.010)\,(.010)}{(0.008)^2 t} \quad (6)$$

and thus t=0.015". If, on the other hand, we assume that h=0.015", w=0.015" and r=0.007", then t=0.044". Both thicknesses t of the YIG disc are reasonable values.

Since GaAs substrates can, for example, be between 20 and 25 mils thick and the ceramic could be between 20 and 50 mils, a disc having a thickness of 44.0 mils would result in the total thickness of FIG. 2 being about one eighth of an inch. The filter assembly 2 of FIG. 1 would be about half of that so that it could be used in a "flat pack" having a height of ¼", whereas the standard YIG filters would be much larger.

The dimensions of the substrate 4 of the filter assembly 2 would be about 0.25 – ×0.25" so as to occupy less space on the MIC then a standard YIG filter.

Although various embodiments of the invention are described herein for purposes of illustration, they are not meant to be limiting. Those of skill in the art may recognize modifications that can be made in the illustrated embodiments. Such modifications are meant to be covered by the spirit and scope of the appended claims.

What is claimed is:

1. A first substrate of dielectric material having a conductive ground plane extending over a first side thereof and a first strip conductor on a second side thereof;

a second substrate of dielectric material having conductive material extending over a first side thereof to form a ground plane and a second strip conductor on a second side thereof;

a first and a second dielectric spacer adhered to and between said second sides of said substrates in such manner that said first and second strip conductors are spaced vertically from each other with said first strip conductor being interposed between said first and second dielectric spacers;

a third dielectric spacer attached to said first conductor;

means for establishing a magnetic field perpendicular to said first conductor; and a YIG disc attached to said third dielectric spacer, whereby RF energy in one of said strip conductors is coupled to the other of said strip conductors.

2. A filter as set forth in claim 1 wherein:

the thickness of said first and second spacers is greater than the sum of the thickness of said third spacer and said YIG disc so that there is a space between said YIG disc and said second substrate.

3. A filter as set forth in claim 1 wherein:

said first substrate is made of ceramic material; and said second substrate is made of one of GaAs or Si.

4. A filter as set forth in claim 1 wherein said first and second conductors each extend beyond line of intersection by one quarter of a wavelength of a nominal operating frequency.

5. A filter as set forth in claim 1 wherein:

said first substrate is made of a ceramic material between 20 and 50 mils in thickness;

said second substrate is made of GaAs between 20 and 25 mils thick; and said YIG disc is about one eight of an inch thick.

* * * * *